US008672458B2

(12) United States Patent
Nakao

(10) Patent No.: US 8,672,458 B2
(45) Date of Patent: Mar. 18, 2014

(54) LIQUID EJECTING HEAD AND LIQUID EJECTING APPARATUS

(75) Inventor: Hajime Nakao, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 15 days.

(21) Appl. No.: 13/294,931

(22) Filed: Nov. 11, 2011

(65) Prior Publication Data

US 2012/0120159 A1 May 17, 2012

(30) Foreign Application Priority Data

Nov. 15, 2010 (JP) ..... 2010-254590

(51) Int. Cl.
*B41J 2/045* (2006.01)

(52) U.S. Cl.
USPC ..... 347/68

(58) Field of Classification Search
None
See application file for complete search history.

(56) References Cited

U.S. PATENT DOCUMENTS

| | | | |
|---|---|---|---|
| 5,530,465 A | 6/1996 | Hasegawa et al. | |
| 6,345,424 B1 | 2/2002 | Hasegawa et al. | |
| 7,481,519 B2 * | 1/2009 | Shimada et al. | 347/70 |

FOREIGN PATENT DOCUMENTS

| | | |
|---|---|---|
| JP | 3379106 B2 | 2/2003 |
| WO | WO 93/22140 A1 | 11/1993 |

* cited by examiner

*Primary Examiner* — Matthew Luu
*Assistant Examiner* — Erica Lin
(74) *Attorney, Agent, or Firm* — Kilpatrick Townsend & Stockton LLP

(57) ABSTRACT

A common electrode includes a plurality of individual sections arranged so as to correspond to pressure chambers that are divided by a plurality of slits, and a base section that joins one end of the individual sections. The individual sections on a base section side gradually widen in plain view. The common electrode has thin film sections at the individual sections and a thick film section at the base section, and the film thickness gradually increases from the thin film sections towards the thick film section in a region between the thin film sections and the thick film section.

12 Claims, 8 Drawing Sheets

LIQUID EJECTING HEAD AND LIQUID EJECTING APPARATUS

The entire disclosure of Japanese Patent Application No: 2010-254590, filed Nov. 15, 2010 is expressly incorporated by reference herein.

BACKGROUND

1. Technical Field

The present invention relates to a liquid ejecting head that ejects liquid droplets through nozzle openings and a liquid ejecting apparatus and, in particular, to an ink jet recording head that ejects ink as a liquid and an ink jet recording apparatus.

2. Related Art

Typical examples of liquid ejecting heads include an ink jet recording head that has a vibrating plate as a portion of pressure chambers that communicate with nozzle openings for discharging ink droplets and deforms the vibrating plate with piezoelectric elements so as to add pressure to ink in the pressure chambers and thus discharge ink droplets through the nozzle openings. The piezoelectric elements used for the ink jet recording head are formed by evenly forming a layer of a piezoelectric material over an entire surface of a vibrating plate using a film forming technique and then cutting the layer into a shape corresponding to the pressure chambers by lithography, thereby forming an independent piezoelectric element per pressure chamber (for example, see Japanese Patent No. 3379106). In Japanese Patent No. 3379106, individual electrodes and a common electrode of a plurality of the piezoelectric elements are provided per piezoelectric element in a comb-like pattern, thereby maintaining the displacement magnitude of a piezoelectric layer and providing excellent discharge properties.

In such a liquid ejecting head, there has been a demand for increased piezoelectric element density for improving printing quality. However, to achieve a higher density, the piezoelectric elements need to be decreased in size, and thus the displacement magnitude deteriorates.

However, when the electrodes are thinned so as to maintain a displacement magnitude, electric resistance rises and voltage drops, so that the piezoelectric elements cannot be made to deform at an even displacement magnitude. This is particularly troublesome since discharge properties become uneven, depending on voltage drops, between the case in which piezoelectric elements are selectively driven and the case in which all the piezoelectric elements are simultaneously driven.

The above problems are found not just in ink jet recording heads but also in liquid ejecting heads that eject liquid other than ink.

SUMMARY

An advantage of some aspects of the invention is that a liquid ejecting head having improved displacement properties and a liquid ejecting apparatus are provided.

A liquid ejecting head according to an aspect of the invention includes pressure chambers that communicate with nozzle openings for ejecting liquid, and piezoelectric actuators that eject liquid droplets through the nozzle openings by generating changes in pressure in the pressure chambers. The piezoelectric actuators have individual electrodes provided so as to correspond to the pressure chambers, a common electrode shared by the piezoelectric actuators, and a piezoelectric layer that is formed between the common electrode and the individual electrodes. The common electrode has a plurality of individual sections that are divided by a plurality of slits and correspond to the pressure chambers, and a base section joining at least one end of the individual sections. The individual sections on the side of the base section gradually widen in plan view. The common electrode has thin film sections provided at the individual sections and a thick film section provided at the base section, and the film gradually thickens from the thin film sections towards the thick film section in a region between the thin film sections and the thick film section.

Since the base section of the common electrode has a large film thickness, electric resistance is reduced and voltage drops are suppressed. As the individual sections of the common electrode have a small film thickness, displacement magnitudes of the piezoelectric actuators also improve. Therefore, variation of displacement magnitudes due to voltage drops is suppressed, and the displacement magnitudes also improve, thereby improving displacement properties. Furthermore, the film thickness gradually increases from the individual section side towards the base section side at the connecting section between the individual sections and the base section, and the width of the individual sections on the base section side gradually increases in plan view. Accordingly, stress concentration is suppressed around the connecting section between the individual sections and the base section and cracking is suppressed at the common electrode. Hence, the disconnection of the common electrode due to crack formation is suppressed, and endurance can improve.

It is preferable that the common electrode have only one end of a plurality of the individual sections joined to the base section.

It is preferable that an enlarging section where the film thickens gradually from the thin film sections towards the thick film section between the two film sections have a curved surface, and that the curved surface is concave. Therefore, stress concentration is suppressed around the connecting section, and formation of cracks are reliably suppressed on the common electrode.

It is preferable that in plan view the individual sections and the base section have curved corners therebetween. Accordingly, stress concentration is suppressed around the connecting section, and cracks are reliably suppressed on the common electrode.

It is preferable that the base section be a laminate that is formed of the same material or different materials. Thus, a common electrode can be easily formed in a desirable shape.

According to another aspect of the invention, a liquid ejecting apparatus includes the liquid ejecting head mentioned above. The liquid ejecting apparatus having improved displacement and endurance properties can be provided.

BRIEF DESCRIPTION OF THE DRAWINGS

The invention will be described with reference to the accompanying drawings, wherein like numbers reference like elements.

DESCRIPTION OF EXEMPLARY EMBODIMENTS

The invention will be described below in detail with reference to the embodiments.

Embodiment 1

Figure 1:
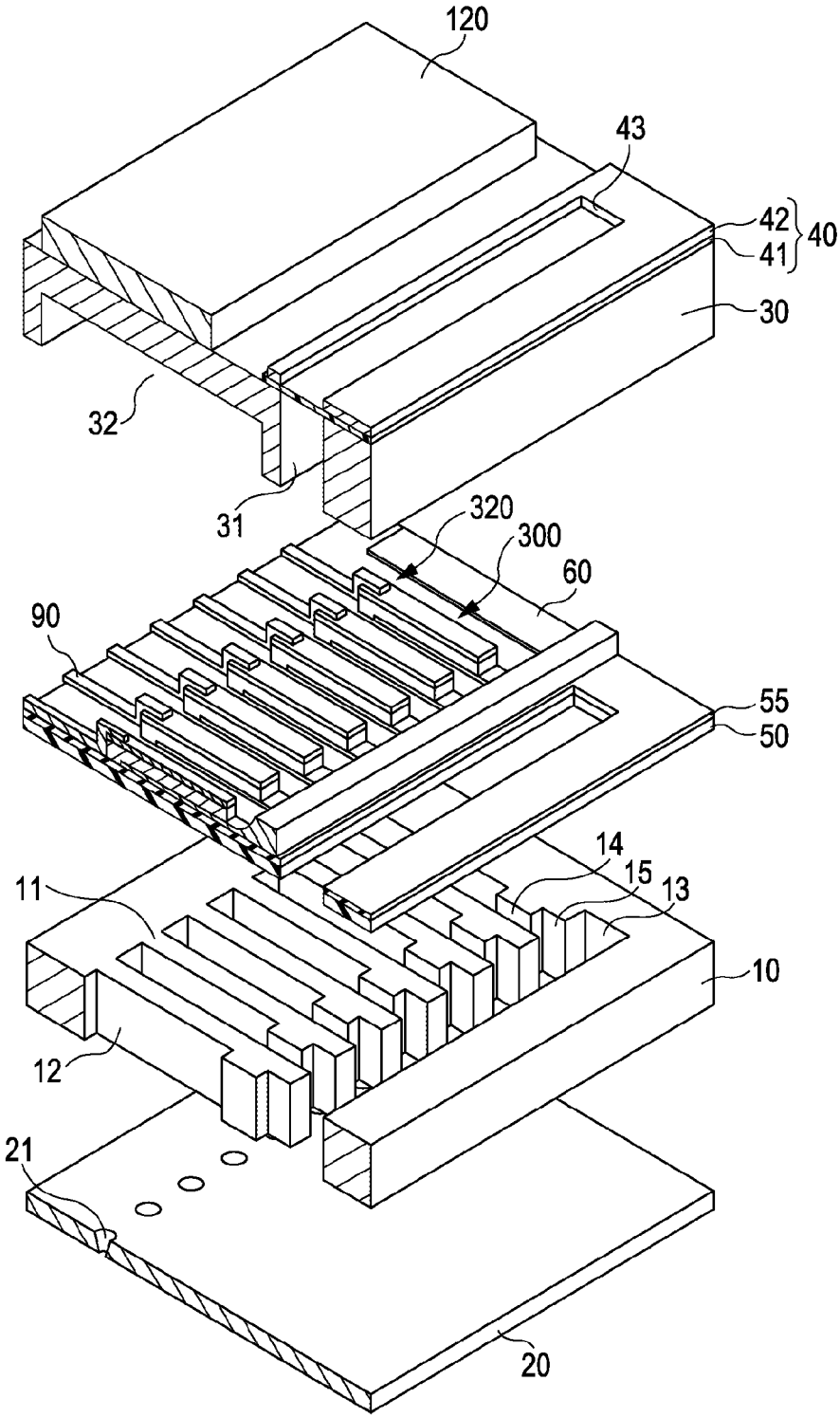
FIG. 1 is an exploded perspective view illustrating a schematic configuration of a recording head in accordance with an embodiment of the invention.
Figure 2A:
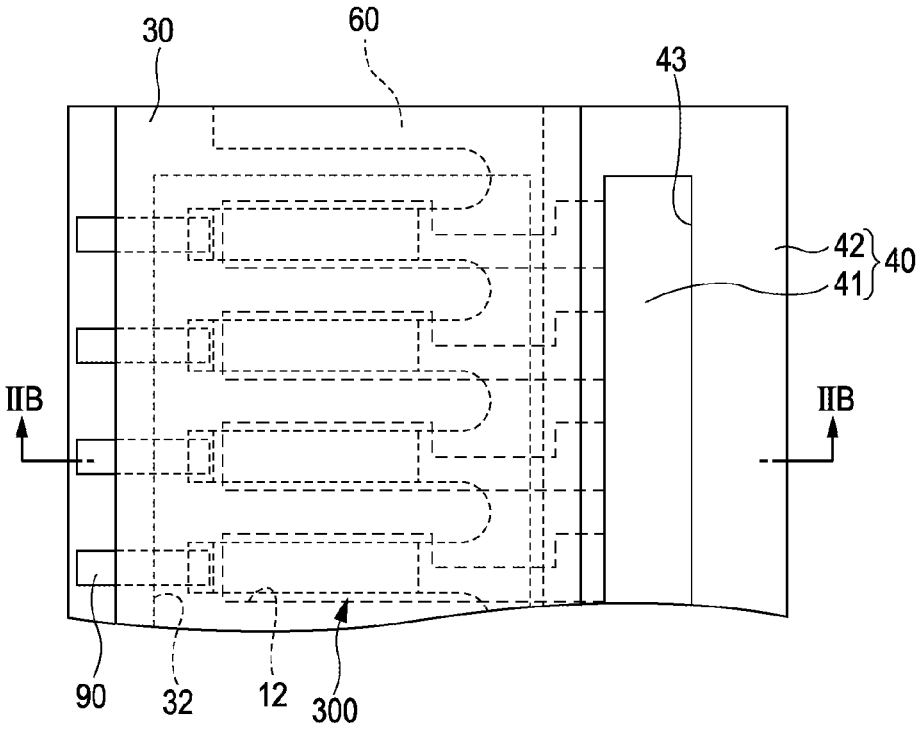
FIG. 2A is a plan view of the recording head in accordance with the embodiment of the invention.
Figure 2B:
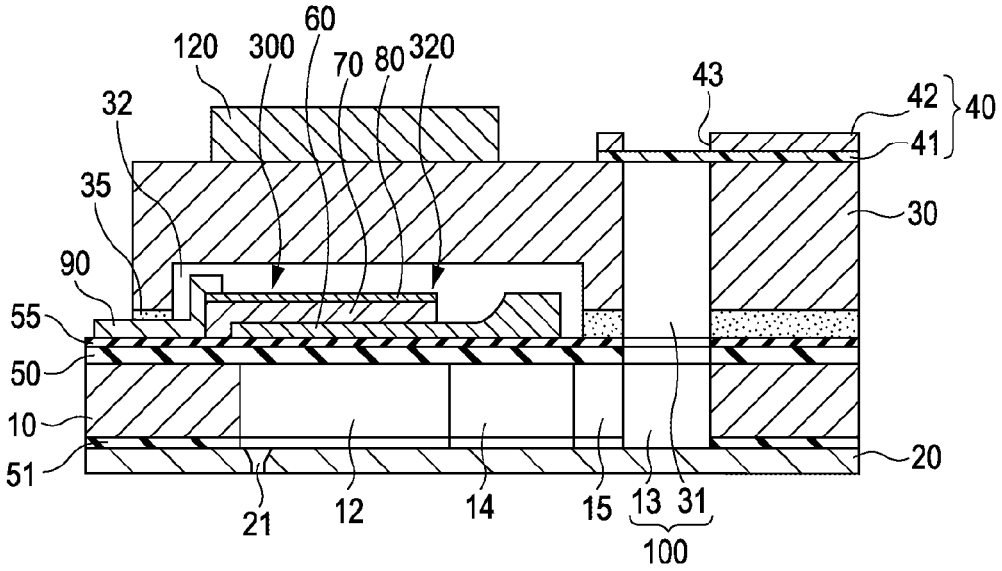
FIG. 2B is a sectional view of the recording head.

FIG. 1 is an exploded perspective view, illustrating a schematic configuration of an ink jet recording head as a liquid ejecting head in accordance with Embodiment 1. FIG. 2A is a plan view of FIG. 1, and FIG. 2B is a sectional view taken from line IIB-IIB of FIG. 2A.

As shown in the figures, a passage-forming substrate 10 is made of a silicon monocrystalline substrate, and is formed with an elastic film 50 made of an oxide film on one side thereof as shown in the embodiment.

The passage-forming substrate 10 has a plurality of pressure chambers 12 divided by a plurality of diaphragms 11 and arranged in parallel in the width direction of the substrate. The passage-forming substrate 10 also has a communication section 13 on the outside in the longitudinal direction of the pressure chambers 12. The communication section 13 and each pressure chamber 12 communicate with each other through an ink supply passage 14 and a communication passage 15 that are provided at each pressure chamber 12. The communication section 13 communicates with a reservoir section 31 of a protection substrate described below, constituting a portion of a reservoir which is a common ink chamber for each pressure chamber 12. The ink supply passages 14 are narrower than the pressure chambers 12, and thus the passage resistance of ink flowing from the communication section 13 into the pressure chambers 12 is kept constant. Although the ink supply passages 14 are formed so as to become narrow on one side in the width direction in the embodiment, the ink supply passages 14 may be formed so as to become narrower on both sides. It is also possible to form ink supply passages that have decreasing thicknesses instead of decreasing widths.

A nozzle plate 20, having nozzle openings 21 that communicate near the ends of the pressure chambers 12 that are opposite to the ends having the ink supply passages 14, is bonded to the open side of the passage-forming substrate 10 with an adhesive, a thermal bonding film or the like. The nozzle plate 20 is made of glass, ceramics, a silicon monocrystalline substrate, stainless steel or the like.

The elastic film 50 is formed on the side of the passage-forming substrate 10 that is opposite the open side as described above, and an insulating film 55 is formed on the elastic film 50. Furthermore, a first electrode 60, a piezoelectric layer 70 and a second electrode 80 are stacked on the insulating film 55 in the process described below, so as to form a piezoelectric actuator 300. Herein, the piezoelectric actuator 300 is a section that contains the first electrode 60, the piezoelectric layer 70 and the second electrode 80. Generally, one of the electrodes of the piezoelectric actuator 300 is a common electrode, and the other electrode and the piezoelectric layer 70 are formed per pressure chamber 12 by patterning. A piezoelectric active section 320 is a section which has the patterned electrodes and the piezoelectric layer 70 and in which a piezoelectric strain is generated by the application of voltage to both electrodes. In this embodiment, the first electrode 60 is a common electrode of the piezoelectric actuators 300, and the second electrode 80 is an individual electrode of the piezoelectric actuators 300. However, the electrodes could be reversed depending on drive circuits and wiring. The combination of the piezoelectric actuators 300 and vibrating plates in which a displacement is generated when the piezoelectric actuators 300 are driven, is called an actuator device herein. In this embodiment, the elastic film 50, the insulating film 55, and the first electrode 60 function as the vibrating plates. However, the invention is not limited to this. For instance, the first electrode 60 may function alone as a vibrating plate without the elastic film 50 and the insulating film. Furthermore, the piezoelectric actuators 300 may substantially work as a vibrating plate by themselves.

In this embodiment, the piezoelectric actuator 300 includes the first electrode 60 made of platinum, the piezoelectric layer 70 made of lead titanate zirconate (PZT), and the second electrode 80 made of iridium. Although the first electrode 60 is made of platinum and the second electrode 80 is made of iridium in this embodiment, the invention is not particularly limited to this. The first electrode 60 and the second electrode 80 may be made of nickel, copper, niobium, ruthenium, rhodium, palladium, silver, tin, osmium, iridium, platinum, gold, bismuth, or a laminated layer or an alloy of these materials. Additionally, the first electrode 60 and the second electrode 80 may be made of conductive materials other than these materials.

Figures 3A, 3B:
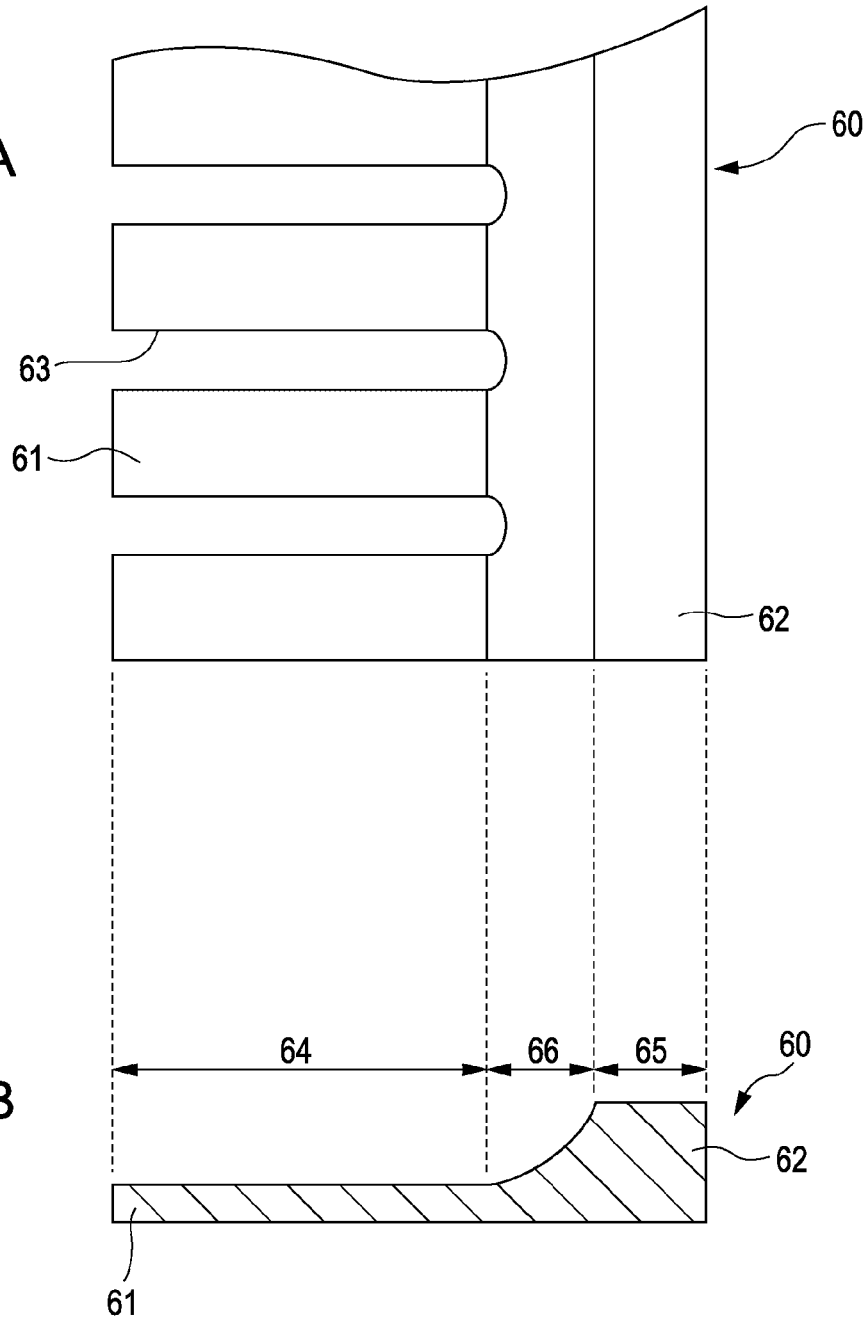
FIG. 3A is a plan view of a common electrode of the recording head in accordance with the embodiment of the invention.
FIG. 3B is a sectional view of the common electrode.

The first electrode 60 of this embodiment will be described in detail with reference to FIGS. 3A and 3B. FIG. 3A is a plan view of the first electrode 60 of this embodiment, and FIG. 3B is a sectional view of the first electrode 60.

The first electrode 60, as illustrated in FIG. 3A, has a plurality of individual sections 61 that are formed corresponding to the pressure chambers 12, and a base section 62 joining one end of the individual sections 61, thereby forming a so-called comb-like shape.

A plurality of individual sections 61 are partitioned with a plurality of slits 63 so as to be formed corresponding to the pressure chambers 12. In other words, each slit 63 is provided so as to oppose the diaphragms 11 that define the sides in the lateral direction of the pressure chambers 12. Though the individual sections 61 are narrower in the lateral direction and longer in the longitudinal direction of the pressure chambers 12 than the pressure chambers 12 in this embodiment, the individual sections may have roughly the same shape as the pressure chambers 12. Moreover, the individual sections 61 may be wider than the pressure chambers 12 in the lateral direction of the pressure chambers 12 and also longer than the pressure chambers 12 in the longitudinal direction of the pressure chambers 12. In either case, each slit 63 between the individual sections 61 needs to oppose the diaphragms 11 that define the sides in the lateral direction of the pressure chambers 12.

The first electrode 60 has thin film sections 64 at the individual sections 61 and a thick film section 65 at the base section 62. Specifically, the film thickness at the base section 62 is greater than the thickness at the individual sections 61. The thickness of the first electrode 60 increases gradually from the thin film sections 64 towards the thick film section 65 between the sections 64 and the section 65. At a connecting section between the individual sections 61 and the base section 62, the thickness gradually increases from the thin film sections 64 towards the thick film section 65. More specifically, an enlarging section 66 having a gradually increasing film thickness from the thin film sections 64 towards the thick film section 65 is provided between the sections 64 and the section 65. In this embodiment, the enlarging section 66 starts from the individual sections 61 on the base section 62 side to the base section 62 of the individual section 61 side as shown in FIG. 3B. Moreover, the enlarging section 66 has a concave surface in this embodiment.

The individual sections 61 on the base section 62 side gradually widen in plan view. Specifically, the ends of the slits 63 on the base sections 62 side gradually narrow in plan view. More specifically, the corners between the individual sections 61 and the base section 62 in plan view are curved, and the ends of the slits 63 on the base section 62 side are curved with narrowing widths and have an R shape. The width indicates a width in the direction in which the individual sections 61 are arranged side-by-side herein.

The base section 62 of the first electrode 60 is made thicker as described above in this embodiment, and therefore the electric resistance of the first electrode 60 can be kept low and voltage drops are controlled, thus suppressing variation of displacement magnitudes. Moreover, by thinning the individual sections 61 of the first electrode 60, the displacement magnitude of the piezoelectric actuators 300 improves in this embodiment. Specifically, the first electrode 60 is formed so as to be thin at the piezoelectric active section 320 where piezoelectric strains are generated by voltage applications, thereby improving the displacement magnitude of the piezoelectric actuators 300. The first electrode 60 is also formed so as to be thick at a region where electric signals are transmitted to each individual section 61, thus keeping the electric resistance low and thus limiting voltage drops. The piezoelectric actuators 300 thus have better displacement properties. The ink jet recording head of this embodiment can carry out high-frequency discharge for discharging a plurality of ink droplets at a fast rate, and thus can perform high-speed printing since the variation of displacement magnitudes is suppressed. Moreover, the displacement magnitude of the piezoelectric actuators 300 improves, and ink discharge also improves.

Furthermore, the connecting section between the individual sections 61 and the base section 62 thickens gradually from the individual section 61 side towards the base section 62 side in this embodiment, and the individual sections 61 on the base section 62 side widen gradually in plan view, thereby suppressing stress concentration near the connecting section between the individual sections 61 and the base section 62 of the first electrode 60 and thus suppressing cracks. The stress concentration includes the concentration of tensile stress near the connecting section generated at the first electrode 60 during the manufacturing process. Therefore, the first electrode 60 has good endurance and is also highly reliable since disconnection due to cracking is suppressed. If the connecting section between the individual sections 61 and the base section 62 has a corner, a crack might form at the corner as a starting point and then might spread over the entire first electrode 60, resulting in discontinuation. However, in this embodiment, the enlarging section 66 has a curved surface, and the stress concentration around the connecting section between the individual sections 61 and the base section 62 is certainly suppressed.

Furthermore, the individual sections 61 of the first electrode 60 are provided so as to correspond to the pressure chambers 12 as described above. Specifically, the slits 63 are arranged above the diaphragms 11, and thus the displacement of the vibrating plates is prevented from decreasing due to the first electrode 60 being restrained with the diaphragms 11. At the same time, residual polarization and strains on the piezoelectric layer 70 are prevented from increasing due to the first electrode 60 being restrained, and deterioration of ink discharging properties can be prevented.

Since the first electrode 60 has the slits 63, stress added on the first electrode 60 and affecting the adjoining piezoelectric actuators 300 is reduced when the piezoelectric actuators 300 are driven for displacement, thus preventing so-called crosstalk, caused by a difference between displacement magnitude when a plurality of piezoelectric actuators 300 are simultaneously driven and displacement magnitude when one of the piezoelectric actuators 300 is selected and driven. Ink discharging properties thus improve and become uniform.

In FIG. 1 and FIGS. 2A and 2B, the piezoelectric layer 70 is made of a piezoelectric material exhibiting electromechanical conversion. Among piezoelectric materials, ferroelectric materials having a perovskite structure are preferable. For example, a ferroelectric material such as lead titanate zirconate (PZT), a material in which a metal oxide such as niobium oxide, nickel oxide or magnesium oxide is added to the ferromagnetic material, or the like is preferably used for the piezoelectric layer 70. The piezoelectric layer 70 is preferably formed by the sol-gel method, MOD method or the like. When the piezoelectric layer is formed so as to be thin, displacement efficiency becomes high and displacement characteristics further improve. The liquid ejecting head can also be decreased in size. The piezoelectric layer 70 is formed so as to have such a thickness that no cracks form during the manufacturing process and also sufficient displacement characteristics are obtained. For example, the piezoelectric layer 70 is formed so as to have a thickness of about 1 to 2 μm in this embodiment.

To each second electrode 80 as an individual electrode of the piezoelectric actuators 300, a lead electrode 90 that is extended onto the insulating film 55 and is made of gold (Au) or the like, is connected.

On the channel-forming substrate 10 formed with the piezoelectric actuators 300, a protection substrate 30 having the reservoir section 31 constituting at least a portion of the reservoir 100, is joined through an adhesive 35. The reservoir section 31 is formed in the thickness direction of the protection substrate 30 over the width of the pressure chambers 12 in this embodiment, and communicates with the communicating section 13 of the passage-forming substrate 10 as described above so as to constitute the reservoir 100, which is a common ink chamber that is shared by the pressure chambers 12. The communicating section 13 of the passage-forming substrate 10 may be divided into the pressure chambers 12, and the reservoir section 31 may be used alone as a reservoir. Furthermore, the pressure chambers 12 alone may be provided at the passage-forming substrate 10, and the ink supply passages 14 communicating the reservoir with each pressure chamber 12 may be provided at members (for instance, the elastic film 50 and the insulating film 55) between the passage-forming substrate 10 and the protection substrate 30.

The protection substrate 30 has a piezoelectric actuator retaining section 32 with an open space for not hindering the operation of the piezoelectric actuators 300, at an area opposing the piezoelectric actuators 300. The piezoelectric actuator retaining section 32 may have enough open space so as not to hinder the operation of the piezoelectric actuators 300, and the space may or may not be sealed up.

For the protection substrate 30, it is preferable to use a material having roughly the same thermal expansion coefficient as the passage-forming substrate 10, such as glass or a ceramic material. In this embodiment, a silicon monocrystalline substrate, the same material as that of the passage-forming substrate 10, is used.

A drive circuit 120 is fixed to the protection substrate 30 so as to drive the piezoelectric actuators 300 arranged in parallel. A circuit board, a semiconductor integrated circuit (IC) or the like may be used for the drive circuit 120. The drive circuit 120 and the lead electrodes 90 are electrically connected through connection wiring made of a conductive wire such as a bonding wire.

On the protection substrate 30, a compliance substrate 40 including a sealing film 41 and a fixing plate 42 is joined. The sealing film 41 is made of a flexible material having low rigidity. One side of the reservoir 31 is sealed with the sealing film 41. The fixing plate 42 is made of a relatively hard material and has an opening 43 that is completely open in the thickness direction, at an area opposing the reservoir 100. Thus, one side of the reservoir 100 is sealed with the sealing film 41 having flexibility.

In the ink jet recording head of this embodiment, ink is supplied from an ink supply port connected to an external ink supplying unit not shown in the figures and then fills space from the reservoir 100 to the nozzle openings 21. Then, in accordance with the recording signals from the drive circuit 120, a voltage is applied between the first electrode 60 and the second electrode 80 corresponding to each pressure chamber 12. Then, the elastic film 50, the insulating film 55, the first electrode 60 and the piezoelectric layer 70 are made to deform, thus raising the pressure inside each pressure chamber 12 and subsequently discharging ink droplets through nozzle openings 21.

The method of manufacturing the ink jet recording head will be described below by referring to FIGS. 4A to 4D and FIGS. 5A to 5D.

Figure 4A:
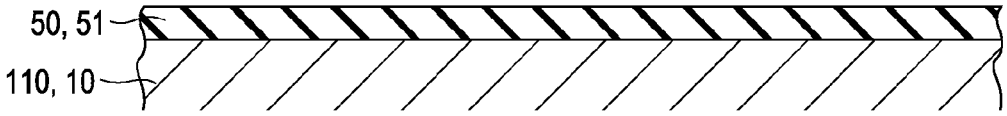
FIGS. 4A to 4D are sectional views illustrating the manufacturing steps of the recording head in accordance with the embodiment of the invention.
Figure 4B:
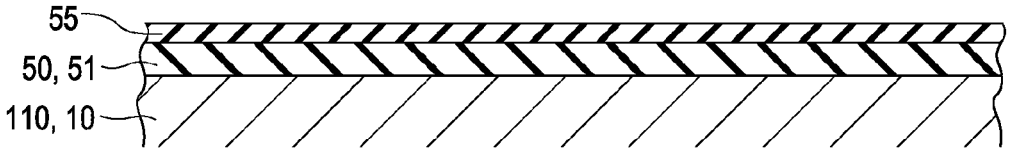
Figure 4C:
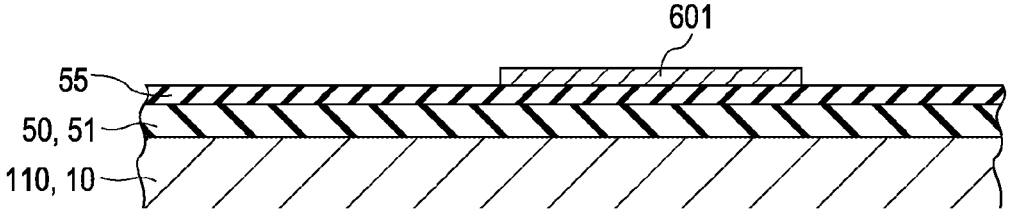

First, as shown in FIG. 4A, a silicon dioxide film 51 made of silicon dioxide ($SiO_2$) is formed as the elastic film 50 on the surface of a passage-forming substrate wafer 110, which is a silicon wafer having a plurality of passage-forming substrates 10 formed in one body. Subsequently, on the elastic film 50 (silicon dioxide film 51), the insulating film 55 made of, for instance, zirconium oxide, is formed as shown in FIG. 4B.

The first electrode 60 made of platinum (Pt) is then formed on the insulating film 55. Specifically, a comb-like pattern is formed so as to correspond to the pressure chambers 12 (see FIGS. 2A and 2B).

Figure 4D:
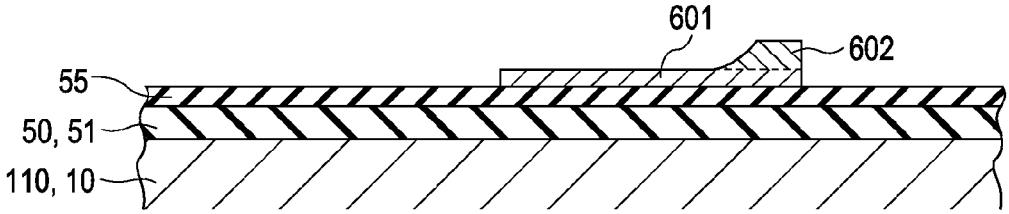

In this embodiment, the first electrode 60 is formed by screen printing. First, a mask is placed at a certain location on the insulating film 55, and a slurry containing platinum is applied in the comb-like pattern as described above through the mask as shown in FIG. 4C, thus forming a first coating film 601 (first coating step). Then, as shown in FIG. 4D, the slurry is further applied to the first electrode 60 (the first coating film 601) over an area of the base section 62, thus forming a second coating film 602 (second coating step). The viscosity of the slurry is adjusted so as to make the end side of the second coating film curved. Then, the first coating film 601 and the second coating film 602 are baked at a certain temperature, thereby providing the first electrode 60. By simultaneously baking the first coating film 601 and the second coating film 602, film adhesion increases. In the above-noted method, a tapering section may be formed at a surface opposite to the individual section 61 side of the base section 62, but the shape of the surface opposite the individual section 61 side of the base section 62 is not a concern. Although the first coating film 601 and the second coating film 602 are simultaneously baked, the second coating film 602 may be applied and baked after preliminarily baking the first coating film 601.

Figure 5A:
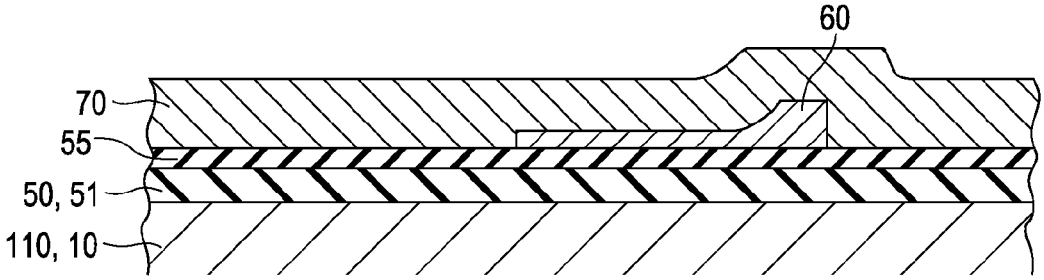
FIGS. 5A to 5D are sectional views illustrating the manufacturing steps of the recording head in accordance with the embodiment of the invention.

Then, as shown in FIG. 5A, the piezoelectric layer 70 made of, for example, lead titanate zirconate (PZT) is formed on the first electrode 60. A material of the piezoelectric layer 70 constituting the piezoelectric actuators 300 includes a ferroelectric piezoelectric material such as lead titanate zirconate (PZT), and a relaxor ferroelectric material in which a metal such as niobium, nickel, magnesium, bismuth or yttrium is added to the ferroelectric piezoelectric material. The composition of the material may be selected in accordance with the properties, purposes and so forth of the piezoelectric actuators 300. The method of forming the piezoelectric layer 70 is not particularly limited. However, in this embodiment, the piezoelectric layer 70 is formed by the sol-gel method in which the layer is obtained by applying and drying a so-called sol having a metal organic material dissolved and dispersed in a solvent for gelation and then by baking at a high temperature. The method is not limited to the sol-gel method, and the piezoelectric layer 70 may be formed by performing a thin film formation method such as the MOD method, sputtering method, or laser ablation method. The piezoelectric layer 70 made of a plurality of piezoelectric films is formed by repeating the step of forming a thin piezoelectric film in the sol-gel method described above.

Figure 5B:
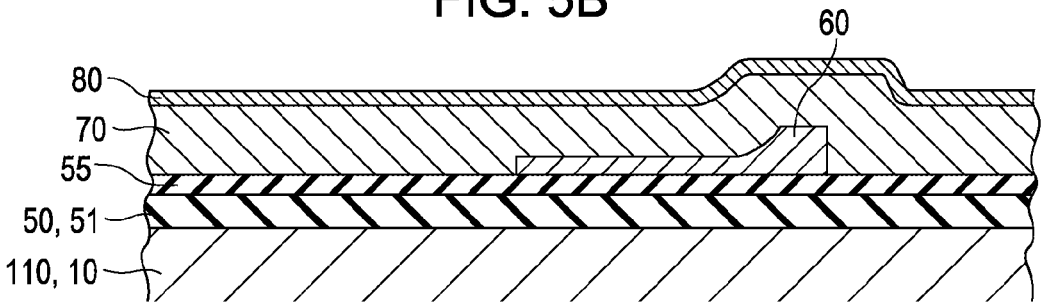

Subsequently, the second electrode 80 is formed on the piezoelectric layer 70 as shown in FIG. 5B.

Figure 5C:
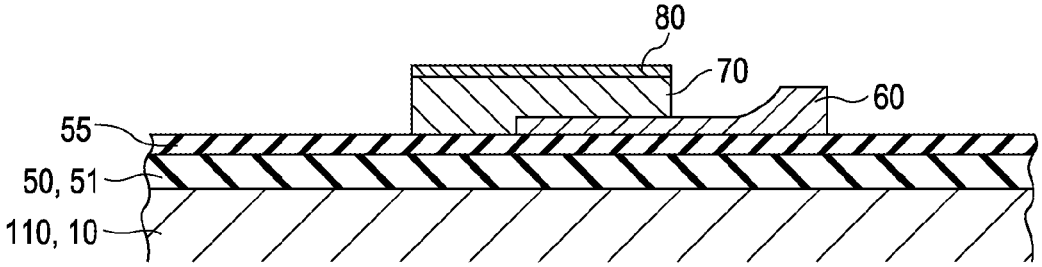

Then, the piezoelectric layer 70 and the second electrode 80 are simultaneously patterned in a certain shape as shown in FIG. 5C. Specifically, portions of the piezoelectric layer 70 and the second electrode 80 corresponding to the diaphragms 11 are removed in the longitudinal direction, thus exposing the first electrode 60. As a result, the piezoelectric layer 70 and the second electrode 80 are provided so as to correspond to the pressure chambers 12. The second electrode 80 and the piezoelectric layer 70 are patterned by dry etching such as reactive ion etching or ion milling.

Figure 5D:
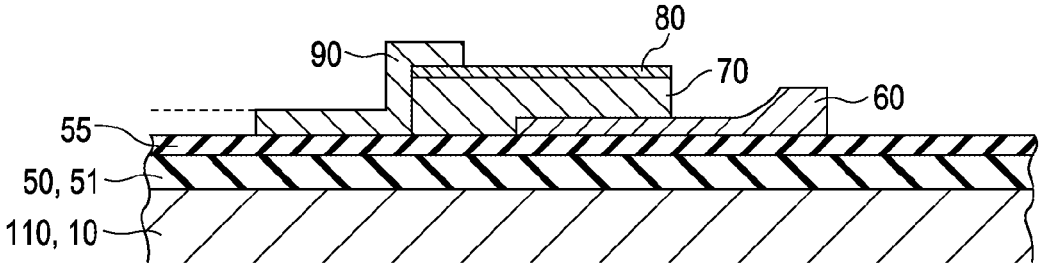

As shown in FIG. 5D, the lead electrode 90 made of gold (Au) is formed over the entire surface of the passage-forming substrate wafer 110, and is then patterned per piezoelectric actuator 300 through a mask pattern made of a resist or the like.

Though not illustrated in the figures, a protection substrate wafer that is a silicon wafer and made to be a plurality of protection substrates 30, is joined with an adhesive 35 to the side of the piezoelectric actuators 300 of the passage-forming substrate wafer 110. The protection substrate 30 is formed with the reservoir section 31, the piezoelectric actuator retaining section 32 and the like in advance. The protection substrate 30 is made of, for example, a silicon monocrystalline substrate of about 400 μm in thickness. By joining the protection substrate 30, the rigidity of the passage-forming substrate 10 improves quite significantly. Subsequently, the passage-forming substrate wafer 110 is treated to have a certain thickness.

A mask film is then formed on the passage-forming substrate wafer 110, and is patterned in a certain shape. The passage-forming substrate wafer 110 is treated by performing anisotropic etching (wet etching) with an alkali solution such as KOH through the mask film, thereby forming the pressure chambers 12, the communication section 13, the ink supply passages 14 and communication passages 15 that correspond to the piezoelectric actuators 300.

The drive circuit 120 is then mounted on the protection substrate wafer, and is also connected to the lead electrode 90 with connection wiring (see FIG. 2). The mask film is removed from the surface of the passage-forming substrate wafer 110 that is to be formed with openings for the pressure chambers 12. The unnecessary sections at the outer periphery of the passage-forming substrate 110 and the protection substrate wafer are removed by cutting such as dicing. A nozzle plate 20 having nozzle openings 21 is joined to the surface opposite the protection substrate wafer of the passage-forming substrate wafer 110, and the compliance substrate 40 is joined to the protection substrate wafer. Then, the passage-forming substrate wafer 110 or the like is divided into a chip-size passage-forming substrate 10 or the like as shown in FIG. 1, thereby manufacturing the ink jet recording head described above.

In this embodiment, the base section of the first electrode 60 is formed by laminating the same material in screen printing, but the method of forming the first electrode 60 is not limited to this. The first electrode 60 is formed by, for instance, sputtering or PVD (Physical Vapor Deposition) method, and is then patterned by dry etching through a resist which is formed on the first electrode 60 in a certain shape by photolithography. At the time of dry etching, the enlarging section 66 may also be simultaneously formed so as to have an increasing film thickness from the individual section 61 side towards the base section 62 side.

Embodiment 2

Figure 6A:
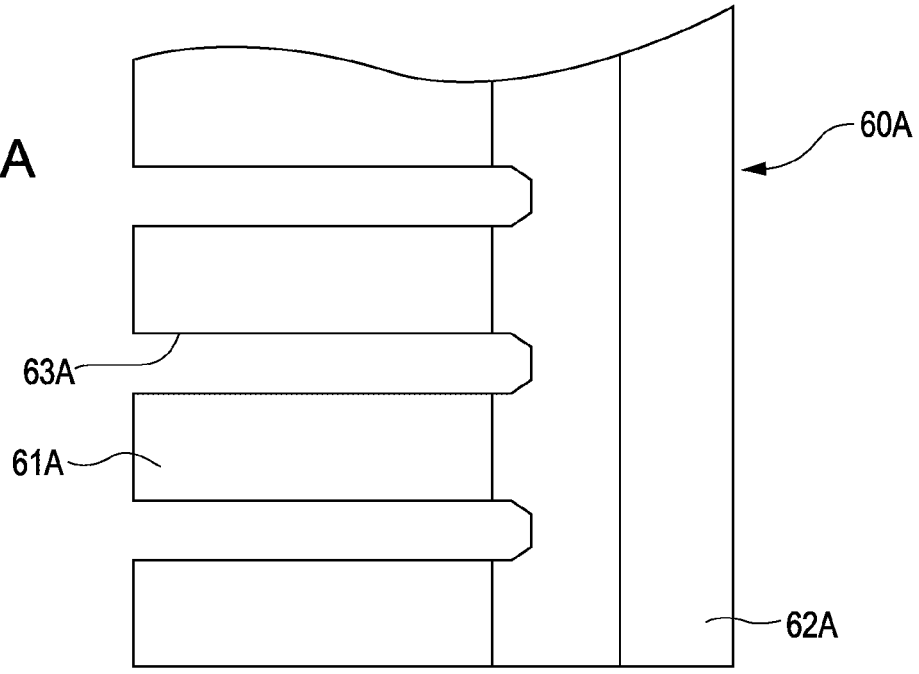
FIG. 6A is a plan view of a common electrode of the recording head in accordance with another embodiment of the invention.
Figure 6B:
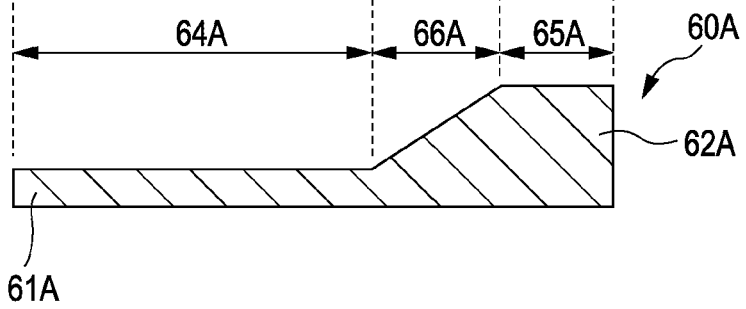
FIG. 6B is a sectional view of the common electrode.

FIGS. 6A and 6B show a first electrode of an ink jet recording head of Embodiment 2. Specifically, FIG. 6A is a top view of the first electrode, and FIG. 6B is a sectional view of the first electrode. Like numbers in this embodiment reference like elements in Embodiment 1, and duplicate explanations will be omitted herein.

As shown in FIG. 6A, a first electrode 60A of this embodiment has a comb-like shape, having a plurality of individual sections 61A provided so as to correspond to the pressure chambers 12, and a base section 62A connecting one end of the individual sections 61A.

The plurality of individual sections 61A are divided by a plurality of slits 63A and are provided so as to correspond to the pressure chambers 12. In other words, each slit 63A opposes the diaphragms 11 defining the sides of the pressure chambers 12 in the lateral direction.

The first electrode 60A has thin film sections 64A at the individual sections 61A and a thick film section 65A at the base section 62A. Specifically, the base section 62A is thicker than the individual sections 61A. The first electrode 60A has an increasing thickness from the thin film sections 64A towards the thick film section 65A between the sections 64A and the section 65A. More specifically, at the connecting section between the individual sections 61A and the base section 62A, the film thickness increases from the individual sections 61A towards the base section 62A. In other words, an enlarging section 66A where the film thickens from the thin film sections 64A towards the thick film section 65A is provided between the sections 64A and the section 65A. In this embodiment, the enlarging section 66 is a region from the individual sections 61A on the base section 62A side to the base section 62A on the individual section 61A side as shown in FIGS. 6A and 6B. The enlarging section 66A has an inclined surface.

The individual sections 61A on the base section 62A side have an increasing width in plan view. In other words, the ends of the slits 63A on the base section 62A side have decreasing widths in plan view. The width indicates the width of the individual sections 61A in the alignment direction. In this embodiment, corners between the individual sections 61A and the base section 62A are slanted in plan view. Specifically, the ends of the slits 63A on the base section 62A side have a chamfered shape with a gradually narrowing width.

In this embodiment, the displacement magnitude of the piezoelectric actuators 300 is improved and the electric resistance is kept low by providing the first electrode 60A with a thin film at the piezoelectric active section 320 where piezoelectric strains are normally generated by the application of voltage, and voltage drops are suppressed by providing a thick film at a region where electric signals are transmitted to each individual section 61A, thereby providing the piezoelectric actuators 300 with improved displacement properties. Since the displacement magnitude does not vary, the ink jet recording head of this embodiment can carry out high-frequency discharge, thus discharging a plurality of ink droplets at a fast pace and allowing high-speed printing. Since the displacement magnitude of the piezoelectric actuators 300 improves, so does ink discharge.

Furthermore, at the connecting section between the individual sections 61A and the base section 62A, film thickness increases from the individual sections 61A towards the base section 62A in this embodiment. As the individual sections 61A on the base section 62A side widen in plan view, stress concentration is suppressed around the connecting section between the individual sections 61 and the base section 62 of the first electrode 60A, thereby suppressing cracking. Hence, the first electrode 60A has a high endurance with suppressed disconnection, and is highly reliable. When the connecting section between the individual sections 61A and the base section 62A has corners at an angle of 90 degrees or more, for example, at an angle of 90 degrees or more between the top face of the individual sections 61A and the ends of the base section 62A on the individual sections 61A side or an angle of 90 degrees between the individual sections 61A and the base section 62A in plan view, stress concentrates at those corners. Thus, a crack forms at the corners as a starting point, thereby generating discontinuation as the crack spreads over the entire first electrode 60A. However, in this embodiment, an angle between the top face of the individual sections 61A and the inclined surface of the enlarging section 66A is less than 90 degrees, or the width of the slit 63A ends on the base section 62A side gradually narrows, forming a chamfered shape. As a result, stress concentration is suppressed around the connecting section between the individual sections 61 and the base section 62.

As described above, the individual sections 61A of the first electrode 60A are provided so as to correspond to the pressure chambers 12. In other words, since the slits 63A are provided above the diaphragms 11 and the first electrode 60A is not restrained with the diaphragms, the displacement of the vibrating plates will not degrade. The residual polarization and strains on the piezoelectric layer 70 are also prevented from increasing as the first electrode 60A is not restrained. Thus, ink discharge characteristics do not deteriorate over time.

Moreover, since the first electrode 60A has the slits 63A, stress on the first electrode 60A affecting the adjoining piezoelectric actuators 300 is reduced when the piezoelectric actuators 300 are driven for displacement. Therefore, so-called crosstalk, a difference between a displacement magnitude when a plurality of piezoelectric actuators 300 are simultaneously driven and a displacement magnitude when one selected from the piezoelectric actuators 300 is driven, is prevented, and thus ink discharge characteristics improve and become uniform.

Other Embodiments

Although each embodiment of the invention is described above, the basic configuration of the invention is not limited to the one mentioned above. For example, in Embodiments 1 and 2, a region from the individual sections on the base section side to the base section on the individual section side is called the "enlarging section" where the film thickness gradually increases from the individual section side towards the base section side, but is not limited to this. It is acceptable as long as the first electrode has a gradually increasing film thickness at a region where no piezoelectric layer 70 is formed thereon. For instance, just the region of the individual sections on the base section side may be the enlarging section, or just the region of the base section on the individual section side may be the enlarging section.

Additionally, the shape of the enlarging section is not limited to the one mentioned above. For example, the section may have continuous convex and concave curved surfaces. In this case, it is preferable that the section have the continuation of a concave surface on the individual section side and a convex surface on the base section side.

Although the enlarging section 66 has a concave surface in Embodiment 1, the surface of the enlarging section 66 may be inclined. The surface of the enlarging section 66 is inclined in Embodiment 2, but may be a concave surface.

Figure 7A:
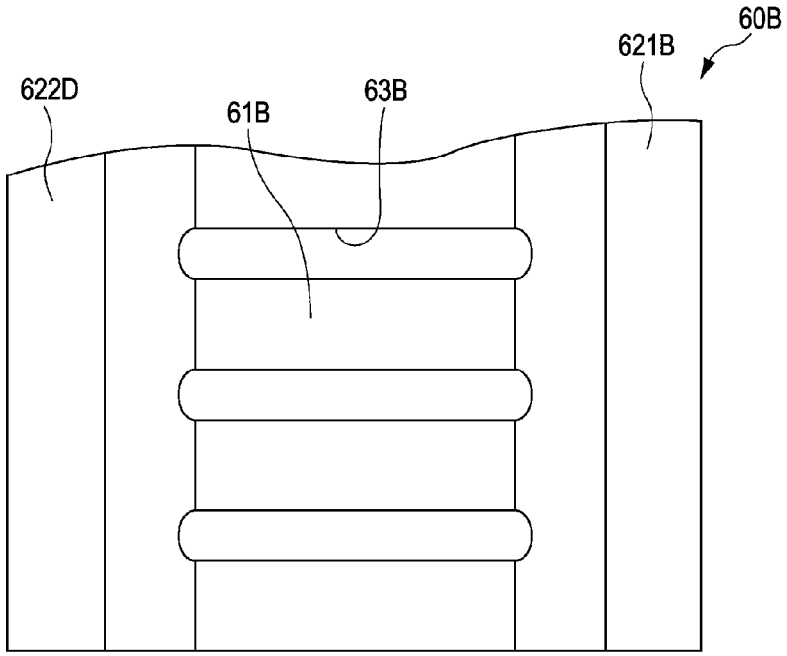
FIG. 7A is a plan view of a common electrode of the recording head in accordance with further another embodiment of the invention.
Figure 7B:
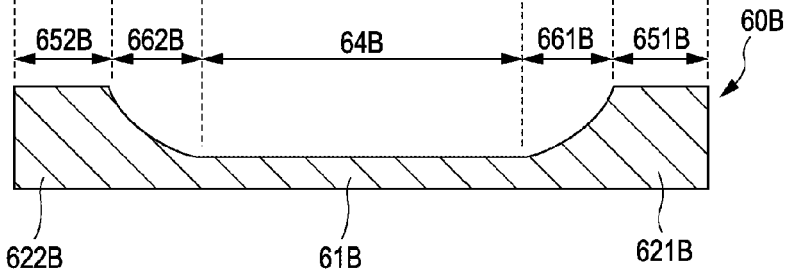
FIG. 7B is a sectional view of the common electrode.

In the first electrode as a common electrode of the above-noted embodiments, the individual sections are fixed to the base section just at one end of the individual sections, but the first electrode is not limited to this. It is acceptable as long as the common electrode has a plurality of individual sections provided so as to correspond to the pressure chambers and the base section for connecting one end of the individual sections. As shown in FIGS. 7A and 7B, the electrode may have a ladder shape where the opposite side to the ink supply passages 14 outside of the adjoining pressure chambers 12 is continuous.

The first electrode 60B shown in FIGS. 7A and 7B has a plurality of individual sections 61B provided so as to correspond to the pressure chambers, a base section 621B connecting one end of the individual sections 61B, and a base section 622B connecting the other end of the individual sections 61B.

The individual sections 61B are divided by a plurality of slits 63B and are provided so as to correspond to the pressure chambers 12. The first electrode 60B has thin film sections 64B provided at the individual sections 61B, a thick film section 651B provided at the base section 621B, and a thick film section 652B at the base section 622B. Specifically, the film thickness at the base section 621B and also at the base section 622B is larger than that at the individual sections 61B. Moreover, between the thin film sections 64B and the thick film section 651B, the film thickness gradually increases from the thin film section 64B towards the thick film section 651B. Similarly, between the thin film sections 64B and the thick film section 652B, the film thickness gradually increases from the thin film sections 64B towards the thick film section 652B. In other words, there is an enlarging section 661B having an increasing film thickness from the thin film sections 64B towards the thick film section 651B between the sections 64B and the section 651B, and there is an enlarging section 662B having an increasing film thickness from the thin film sections 64B towards the thick film section 652B between the sections 64B and the section 652B. The enlarging sections 661B and 662B have concave surfaces.

Furthermore, the ends of the individual sections 61B gradually widen in plan view. Specifically, the individual sections 61B on the base section 621B side as well as the base section 622B side gradually widen in plan view. More specifically, the ends of the individual sections 61B have curved corners on the base section 621B side and also on the base section 622B side in plan view.

The above-noted configuration provides the same effects as in Embodiment 1. Additionally, though the base sections (621B, 622B) on both ends of the individual sections 61B have the thick film sections 652 (651B, 652B) that are thicker than the individual sections 61B, the thick film section may be provided to one of the base sections and the other base section may have the same thickness as the individual sections. At the connecting section between the base section as the thick film section and the individual sections 61B, the film thickness gradually increases from the individual section 61B side towards the base section side. It is preferable that voltage be applied from the side of the base section, which is the thick film section. In FIGS. 7A and 7B, the enlarging sections 661B and 662B have concave surfaces, but may have inclined surfaces. Although the corners between the individual sections 61B and the base section 621B or the base section 622B are curved in plan view, they may be slanted.

In the embodiments described above, the first electrode is a common electrode and the second electrodes 80 are individual electrodes, but the first electrode may be an individual electrode and the second electrode 80 may be a common electrode. Even in this case, the common electrode has a thin film section at an individual section, a thick film section at a base section, and an enlarging section 66C (see FIG. 8) between the thin film section and the thick film section that thickens from the thin film section towards the thick film section. The individual sections on the base section side ought to have a gradually increasing width in plan view.

Figure 8:
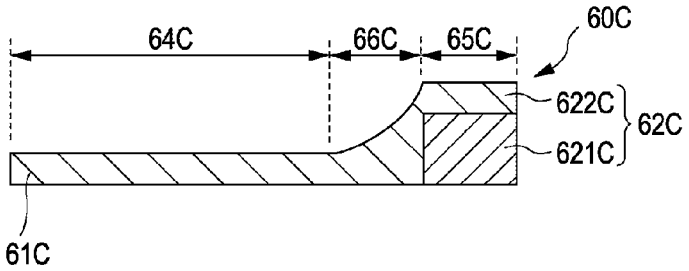
FIG. 8 is a sectional view of a common electrode of the recording head in accordance with still another embodiment of the invention.

In the above-noted embodiments, the first electrode is made of one layer, but the first electrode may be a laminate made of the same material or different materials. The first electrode formed by laminating the same material is a first electrode having an interface. For example, as shown in FIG. 8, a first electrode 60C has a plurality of individual sections 61C made of platinum, and a base section 62C connecting one end of a plurality of individual sections 61C. The base section 62C may include a first base section 621C made of a material having low electric resistance and a second base section 622C made of platinum. Similarly, the first electrode 60C has thin film sections 64C provided at the individual sections 61C, a thick film section 65C provided at the base section 62C, and an enlarging section 66C provided between the thin film sections 64C and the thick film section 65C. The first electrode 60C has an increasing film thickness from the thin film sections 64C towards the thick film section 65C. The width of the individual sections 61C on the base section 62C side gradually increases in plan view.

A protection film made of an insulating material having resistance to moisture may be formed at a section, except for the region corresponding to the pressure chambers 12 of the piezoelectric actuators 300. It is preferable to use an inorganic insulating material such as silicon oxide (SiOx), tantalum oxide (TaOx) or aluminum oxide (AlOx), particularly, aluminum oxide (AlOx) as an inorganic amorphous material such as alumina ($Al_2O_3$), for the protection film.

A silicon monocrystalline substrate is used as the channel-forming substrate 10 in the embodiments mentioned above, but the substrate is not limited to this. For example, a SOI substrate, glass substrate, MgO substrate or the like may be used in the invention. Although the elastic film 50 made of silicon dioxide is provided as the lower-most layer of the vibrating plates, the configuration of the vibrating plates is not particularly limited to this.

As a pressure generator for discharging liquid droplets through nozzle openings with pressure variations, a recording head having flexural vibration-type piezoelectric actuators in which a first electrode, a piezoelectric layer and a second electrode are sequentially stacked, is described in the above-noted embodiments. However, the same effects are also obtained from an ink jet recording head having thick-film-type piezoelectric actuators.

Figure 9:
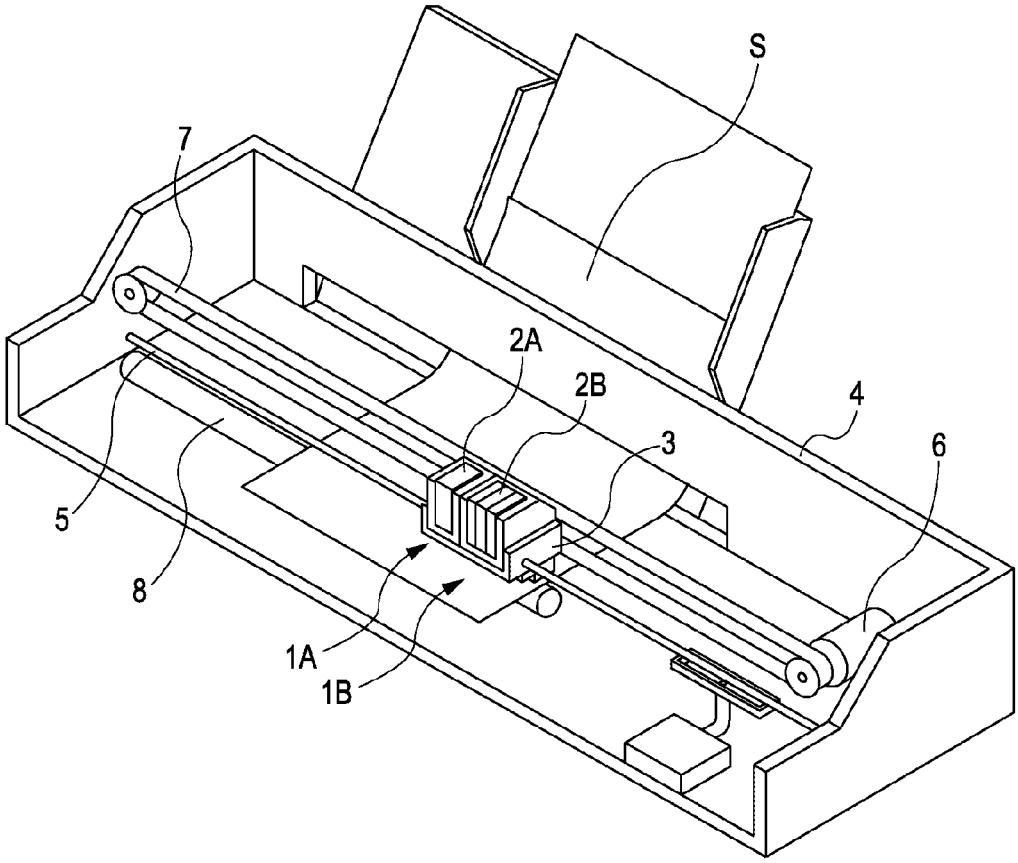
FIG. 9 is a schematic perspective view, illustrating an embodiment of a recording apparatus in accordance with the invention.

The ink jet recording head of the above-mentioned embodiments constitutes a portion of a recording head unit having ink passages which communicate with ink cartridges or the like, and is installed on an ink jet recording apparatus. FIG. 9 is a schematic view, illustrating an example of the ink jet recording apparatus.

As illustrated in FIG. 9, cartridges 2A and 2B constituting an ink supplying unit are provided in an attachable/detachable manner to recording head units 1A and 1B having the ink jet recording head. A carriage 3 installed with the recording head units 1A and 1B is movable in the axial direction to a carriage shaft 5 that is fixed to the apparatus main body 4. The recording head units 1A and 1B discharge a black ink composition and a colored ink composition, respectively.

As a driving force transmits from a driving motor 6 to the carriage 3 through a plurality of gears and a timing belt 7 not shown in the figure, the carriage 3 loaded with the recording head units 1A and 1B shifts along the carriage shaft 5 in the main scanning direction. On the other hand, a platen 8 is installed on the apparatus main body 4 along the carriage shaft 5. A recording sheet S as a recording medium such as paper is supplied with a sheet supply roller or the like not shown in the figure, and is wound around the platen 8 in the sub-scanning direction and is then transported.

In the embodiment shown in FIG. 9, each of the ink jet recording head units 1A and 1B has one ink jet recording head, but may have two or more ink jet recording heads.

The ink jet recording apparatus described above shows an example in which ink jet recording heads are installed on the carriage 3 and shift in the main scanning direction, but is not limited to this example. The invention is applicable to a so-called line type recording apparatus in which ink jet recording heads are fixed and printing is carried out by shifting the recording medium S such as paper in a sub-scanning direction.

The above-mentioned embodiments describe the ink jet recording head as an example of a liquid ejecting head, but the invention targets a wide range of liquid ejecting heads as a whole and is applicable to liquid ejecting heads that eject liquids other than inks. Other liquid ejecting heads include, for instance, various recording heads used for image recording apparatuses such as printers, color material ejecting heads used in manufacturing color filters such as those used in liquid crystal displays, electrode material ejecting heads used to form electrodes such as organic EL displays and FEDs (field emission displays), and bio-organic compound ejecting heads used to manufacture bio-chips.

Additionally, the invention is not limited to an actuator device that is installed on a liquid ejecting head represented by an ink jet recording head, but is applicable to an actuator device installed on other apparatuses.

What is claimed is:

1. A liquid ejecting head comprising:

pressure chambers that communicate with nozzle openings for ejecting liquid; and piezoelectric actuators configured to cause pressure variations in the pressure chambers so as to discharge liquid droplets through the nozzle openings;

wherein the piezoelectric actuators comprise individual electrodes that are independently disposed so as to correspond to the pressure chambers, a common electrode that is shared by a plurality of the piezoelectric actuators, and a piezoelectric layer that is provided between the common electrode and the individual electrodes, wherein the common electrode has defines an X direction, a Y direction generally transverse to the X direction, and a Z direction generally transverse to both the X and Y directions, and wherein the common electrode comprises:

a plurality of individual sections extending along the X direction;

a plurality of slits dividing the individual sections and extending along the X direction; and a base section joining at least one X-direction end of the individual sections;

wherein the individual sections are arranged so as to correspond to the pressure chambers, and wherein the individual sections on a base section side gradually widen in the Y direction, and wherein the common electrode further comprises:

thin film sections that are provided at the individual sections; and a thick film section that is provided at the base section, wherein a film thickness in the Z direction gradually increases from the thin film sections towards the thick film section in a region between the thin film sections and the thick film section.

2. The liquid ejecting head according to claim 1, wherein the base section joins exactly one X-direction end of the plurality of individual sections.

3. The liquid ejecting head according to claim 1, wherein the region in which the film thickness gradually increases in the Z direction from the thin film sections towards the thick film section has a curved surface.

4. The liquid ejecting head according to claim 3, wherein the curved surface of the region in which the film thickness gradually increases in the Z direction from the thin film sections towards the thick film section is concave.

5. The liquid ejecting head according to claim 1, wherein the individual sections and the base section have curved corners therebetween.

6. The liquid ejecting head according to claim 1, wherein the base section is a laminate that is formed of the same material or different materials.

7. A liquid ejecting apparatus comprising the liquid ejecting head according to claim 1.

8. A liquid ejecting apparatus comprising the liquid ejecting head according to claim 2.

9. A liquid ejecting apparatus comprising the liquid ejecting head according to claim 3.

10. A liquid ejecting apparatus comprising the liquid ejecting head according to claim 4.

11. A liquid ejecting apparatus comprising the liquid ejecting head according to claim 5.

12. A liquid ejecting apparatus comprising the liquid ejecting head according to claim 6.

* * * * *